US006333015B1

(12) United States Patent
Lewis

(10) Patent No.: US 6,333,015 B1
(45) Date of Patent: Dec. 25, 2001

(54) SYNTHESIS GAS PRODUCTION AND POWER GENERATION WITH ZERO EMISSIONS

(76) Inventor: Arlin C. Lewis, P.O. Box 1568, Libby, MT (US) 59923

( * ) Notice: Subject to any disclaimer, the term of this patent is extended or adjusted under 35 U.S.C. 154(b) by 0 days.

(21) Appl. No.: 09/634,650

(22) Filed: Aug. 8, 2000

(51) Int. Cl.[7] ..... C01B 31/20
(52) U.S. Cl. ..... 423/437.2; 423/418.2
(58) Field of Search ..... 423/418.2, 437.2

(56) References Cited

U.S. PATENT DOCUMENTS

| | | | | |
|---|---|---|---|---|
| 233,860 | | 11/1880 | Jerzmanowski . | |
| 906,441 | | 12/1908 | Marconnet . | |
| 1,146,627 | | 7/1915 | Koppers . | |
| 2,163,148 | | 6/1939 | Linder . | |
| 2,593,257 | | 4/1952 | Bradley . | |
| 3,635,672 | * | 1/1972 | Johnson | 423/418.2 |
| 3,866,411 | | 2/1975 | Marion . | |
| 3,868,817 | | 3/1975 | Marion . | |
| 4,066,420 | | 1/1978 | Danguillier . | |
| 4,095,960 | | 6/1978 | Schuhmann, Jr. . | |
| 4,135,361 | | 1/1979 | Eisenhaure . | |
| 4,180,387 | | 12/1979 | Rudolph . | |
| 4,188,892 | | 2/1980 | Kiefer . | |
| 4,190,636 | * | 2/1980 | Schmerling et al. | 423/418.2 |
| 4,193,259 | | 3/1980 | Muenger . | |
| 4,542,114 | * | 9/1985 | Hegarty | 423/437.2 |
| 4,583,993 | * | 4/1986 | Chen | 423/418.2 |
| 4,666,490 | | 5/1987 | Drake . | |
| 4,762,528 | * | 8/1988 | Reichl | 423/437.2 |
| 4,881,366 | | 11/1989 | Nurse . | |
| 4,954,137 | | 9/1990 | Potter . | |
| 4,976,940 | * | 12/1990 | Paulson | 423/648.1 |
| 5,069,765 | | 12/1991 | Lewis . | |
| 5,177,952 | | 1/1993 | Stone . | |
| 5,430,236 | | 7/1995 | de Macedo . | |
| 5,595,059 | | 1/1997 | Huber . | |
| 5,603,684 | | 2/1997 | Wetmore . | |
| 5,724,805 | | 3/1998 | Golomb . | |
| 5,950,548 | | 9/1999 | Martin . | |

* cited by examiner

*Primary Examiner*—Wayne Langel
(74) *Attorney, Agent, or Firm*—Bacon & Thomas

(57) ABSTRACT

A process and apparatus for producing and burning synthesis gas. Carbonaceous waste material is pyrolytically decomposed in a primary reactor in the presence of steam to produce raw product gas containing $H_2$ and CO. The raw product gas and $CO_2$ is then introduced into a coke containing secondary reactor under pyrolyzing conditions, so that the $CO_2$ and coke react to produce combustible gas having an increased CO content. The combustible gas is mixed with oxygen and $CO_2$ to produce a combustible mixture which is burned as a fuel to produce heat, $CO_2$ and $H_2O$. A portion of the produced $CO_2$ is recovered and used as the source of $CO_2$ gas in the combustible mixture and as a source of $CO_2$ gas for the secondary reactor. Preferably filters and scrubbers are used in a closed loop system to avoid undesirable emissions into the environment.

26 Claims, 2 Drawing Sheets

SYNTHESIS GAS PRODUCTION AND POWER GENERATION WITH ZERO EMISSIONS

BACKGROUND OF THE INVENTION

1. Field of the Invention

The present invention relates to the field of synthesis gas production and to the field of synthesis gas combustion for the generation of power (e.g., generation of electricity) with little or no environmental pollution. In particular, the invention pertains to a closed loop system for the generation and use of synthesis gas for electric power production with zero emissions.

2. Background Information

It is well known in the art that a combustible gas mixture can be produced by the pyrolytic decomposition of a carbonaceous material such as wood, organic refuse, coal and coke. Typically the carbonaceous material is pyrolytically decomposed by contacting hot carbonaceous material with steam under pyrolizing conditions in a vessel. The products of pyrolytic decomposition are mainly hydrogen and carbon monoxide.

It is known to produce a combustible gaseous product which comprises hydrogen and carbon monoxide by the water gas system wherein water or steam is reacted with incandescent carbonaceous material. It is known to use a two-step operation wherein a bed of carbonaceous material, such as coke, is first oxidized by passing air therethrough until the material becomes incandescent and, in the second step, passing steam through the incandescent material to yield the product gasses, including hydrogen and carbon monoxide according to the following chemical equation:

$$H_2O+C \rightarrow H_2+CO$$

The bed of coke is cooled during the second step, and the first step of air oxidation must be repeated in order to reheat the bed.

It is also known to heat the bed of carbonaceous material electrothermally by using carbon or graphite electrodes. Electrothermic gasification is accomplished by placing the electrodes in contact with the material and applying a sufficient electrical potential to the electrodes, thereby causing resistive heating of the material to sufficiently elevated temperatures which result in the gasification reactions. Water required for the gasification reactions is provided in the form of injected steam or as water vapor from a reservoir located in the bottom of the reactor vessel. In addition to utilizing electrodes for resistive heating, it is also known to carry out the water gas reaction by utilizing an electric arc for heating the material to the required elevated temperatures.

Various technical and economic deficiencies have been noted with respect to the aforementioned prior art technology. U.S. Pat. No. 5,069,765, the specification of which is incorporated herein by reference, is said to provide a more energy efficient and environmentally acceptable method for manufacturing combustible gases from a wide variety of carbonaceous materials. The process described in the aforementioned patent uses a primary reactor, a secondary reactor and optionally a tertiary reactor which are connected in series. A charge of carbonaceous material is fed into the primary reactor which contains electrodes therein for creating an electric arc zone. A constant level of charge is maintained in the reactor and a supply of water for vaporization by the arc is maintained at a level just below the arc zone. When a continuous electric arc is maintained at the electrodes, the intense heat of the arc creates an "arc pocket" in the feed charge at the arc zone, thereby exposing the downwardly feed charge at the periphery of the pocket and the gases and vapors within the pocket to the thermal and photochemical effects of the arc. The primary reactor produces a raw product gas which contains mainly hydrogen and carbon monoxide. It is said that the raw product gas produced in the primary reactor is generally unsuitable for direct use because of its high (approximately 10%) carbon dioxide content.

In order to deal with the undesirable high level of carbon dioxide, the raw product gas is sent to a secondary reactor for reaction with a bed of coke contained therein. The top of the secondary reactor is provided with a single carbon electrode which is positioned within the bed so that the terminal end of the electrode is spaced from the upper level of the coke bed a desired distance in order to permit the creation of an arc between the electrode and the coke bed. In operation, arcing and resistance heating occurs throughout the height of the coke bed which causes the bed to be heated to incandescence. Raw product gas in the secondary reactor is first subjected to the electrothermal and photochemical effects of the arc and thereafter the gas passes downwardly through the incandescent coke bed for further reaction. This results in a reduction in the carbon dioxide content of the product gas. As noted above, it is desired to reduce the carbon dioxide content of the product gas because the gas coming from the primary reactor is unsuitable for direct use because of its high carbon dioxide content. It is said that the refined product gas having a low carbon dioxide content is suitable for combustion in a power generating plant. Thus, it is clear from the disclosure of this patent that the carbon dioxide content of the gas which is burned in the power plant must be minimized.

All gasification processes such as mass burn, incineration, fluidized bed as well as the process described in U.S. Pat. No. 5,069,765 must deal with the problem of removing the inert ash products from the gasifier. In all of the gasification processes in use today, large amounts of ash products, clinkers, etc., fall down onto a metal conveyor or screw system. This allows the removal of the ash from the gasifier to an ash holding compartment where the products are allowed to cool. Costly equipment is generally required to remove pollutants from the ash. After the removal of pollutants from the ash, the ash may then be disposed of in a landfill. Often, the ash products are not completely reacted and there can be as much as about 37% by weight of these ash products left over from the un-reacted feed material.

It is known to remove the ash products from the gasifier and then convey the ash to another vessel that is equipped with electrodes which are adapted to heat the ash to form a molten product which is poured into molds where it is allowed to cool into a glass-like substance. This process is called "vitrification". However, this process is quite cumbersome and there is a possibility that pollutants can be released into the atmosphere unless costly additional equipment is used during the vitrification process. It would therefore be highly desirable to adapt the primary reactor, such as the primary reactor of U.S. Pat. No. 5,069,765 so that the desired vitrification process can be conducted within the gasification vessel so that all potential pollutants which are released from the ash during the vitrification process can remain in the system for further breakdown when subjected to the high temperature pyrolysis conditions. It would also be highly desirable to provide a primary gasifier which avoids the problems associated with clinkers which fall down onto the aforementioned metal conveyor or screw system.

Although the refined product gas produced in accordance with U.S. Pat. No. 5,069,765 is highly refined, the power plants in which this type of gas is combusted typically use air to support the combustion. It is well known that when ambient air or atmospheric air is used for combustion, various types of pollutants such as oxides of nitrogen ($NO_x$), carbon monoxide and huge amounts of $CO_2$ are released into the atmosphere. These unwanted pollutants can be removed by the use of various types of catalytic converters or by the use of other costly gas cleaning equipment to meet EPA standards. Thus it would be highly desirable to produce synthesis gas and burn it for the production of power without releasing these or other pollutants into the environment.

In most combustion processes where ambient air or atmospheric air is used, the combustion mixture includes a mixture of gases which are naturally found in the atmosphere. These gases include nitrogen, oxygen, argon and other small amounts of inert gases. During combustion, air enters into the combustion chamber along with a suitable amount of fuel. This fuel can be either liquid or gaseous. The fuel/air mixture is typically compressed and ignited for combustion. The products of combustion are released into the atmosphere. Before being released into the atmosphere, however, considerable cleaning such as by catalytic conversion is necessary to meet emission standards.

The most abundant gases which are used in the above described prior art combustion process are nitrogen and oxygen. The oxygen is necessary as an oxidizer for reaction with the fuel to produce large quantities of heat. This reaction would be quite rapid and could cause severe damage to any engine or power plant if it were not for the large quantities of nitrogen which are present in the atmospheric air. In particular, the nitrogen is considered to be desirable in the combustion process due to the fact that it is rapidly heated and therefore expands and aids in the energy output of the engine or power plant. If the nitrogen were not present, an uncontrollable explosion would occur due to the rapid reaction of oxygen with the fuel. Thus, nitrogen is typically included in the oxidizing gas mixture even though it presents problems with respect to pollution. It would therefore be highly desirable to provide a gasification procedure in which the synthesis gas which is produced can be safely and efficiently combusted for the production of power or heat without causing the aforementioned damage and pollution.

It is also known that currently available gasification processes, such as coal gasification and natural gas generating plants, and combustion procedures used in typical coal-fired generating plants, are faced with the difficult task of cleaning the stack gases to meet stringent EPA regulations. Typically, in these procedures, costly scrubbing and pollution reducing equipment is necessary to treat the stack gases before they are released to the atmosphere. A gasification and combustion process which does not produce any stack gases would therefore be highly desirable.

Also, conventional gasification and combustion processes typically produce contaminated cooling waters and scrubbing waters as well as sludges which cannot be discharged into the environment without harming the environment. Therefore, a gasification and combustion process which does not require discharging cooling water, scrubbing water and sludges into the environment would be highly desirable. In particular, it would be highly desirable to produce a gasifier in which the ash can be efficiently and safely vitrified within the gasifier and discharged therefrom without releasing undesirable pollutants into the atmosphere. In addition it would be highly desirable to produce a gasification and combustion process in which stack gases are eliminated and in which materials such as sludge, cooling water and scrubbing water are recycled through the system so that the system produces zero emissions and zero water pollution. Until the present invention, no one has developed such a system which effectively deals with all the aforementioned problems and environmental concerns.

Various types of gasifiers and/or combustion systems are known in the prior art. For example U.S. Pat. No. 233,860 discloses a gasifier which includes a bottom portion for the collection of slag and molten metal therein. An upper tap is provided for withdrawing molten slag from the device and a lower tap is provided for withdrawing molten metal from the device. The device also includes a steam injection pipe for the introduction of steam into the reactor.

U.S. Pat. No. 2,593,257 discloses a furnace which collects molten slag and metal at the bottom portion thereof. The device includes a discharge outlet for removing slag and a slightly lower discharge outlet for discharging molten metal.

U.S. Pat. No. 2,163,148 discloses a water-gas generator which includes a bottom portion for the collection of molten slag. The device also includes a discharge conduit for removing the molten slag from the reactor.

U.S. Pat. Nos. 5,430,236; 4,188,892; 4,666,490; 5,603,684; 5,950,548 and 4,180,387 disclose the vitrification of ash to produce an ash product which can be safely disposed of.

U.S. Pat. No. 5,724,805 discloses a power plant which is operated by combusting gaseous fuel such as synthesis gas with substantially pure oxygen as an oxidizer in the presence of carbon dioxide as a diluent. Carbon dioxide produced during combustion is recirculated for use as a diluent gas. It is said that the process emits virtually no pollutants due to the use of carbon dioxide as a diluent and substantially pure oxygen as the oxidizing gas.

U.S. Pat. No. 3,866,411 discloses combining a process for producing synthesis gas with a combustion procedure wherein the gas is burned for the production of power. The combustion portion of the process optionally uses substantially pure oxygen as an oxidizing gas in the presence of flue gas produced in the process. The flue gas includes carbon dioxide. Of similar interest is U.S. Pat. No. 3,868,817.

U.S. Pat. No. 4,881,366 teaches that burning carbon monoxide with oxygen reduces emissions of nitrogen oxides.

Additional patents which are relevant to the general technical field of this invention include U.S. Pat. Nos. 5,135,361; 5,177,952 and 5,595,059.

SUMMARY OF THE INVENTION

It is an objective of this invention to provide a process in which synthesis gas is produced from carbonaceous material and is used as a fuel in a furnace or power plant (e.g., electric power plant) without the release of stack gases into the atmosphere.

It is a further objective of this invention to provide a process in which synthesis gas is produced in a pyrolytic decomposition reactor in which ash is melted therein and eliminated from the reactor as a molten material which is then solidified as an environmentally safe vitrified material.

It is a further objective of this invention to produce a process in which synthesis gas is produced from carbonaceous material and is used as a fuel in a furnace or power plant without release of contaminated water, sludge or solids into the environment to thereby prevent water pollution.

It is a further objective of this invention to provide an apparatus for carrying out the above processes.

These and other objectives are carried out by the below described process and apparatus.

Carbonaceous material such as organic waste (e.g., agricultural waste, wood chips and hogwood, petroleum coke, coal, solid municipal waste, sewage sludge, rubber tires and paper mill sludge) is fed into a primary reactor for pyrolytic decomposition. The primary reactor is utilized so that inexpensive combustible material can be pyrolytically decomposed to economically produce synthesis gas according to known pyrolitic reactions. The primary reactor may be a conventional primary reactor such as the primary reactor described in U.S. Pat. No. 5,069,765; although, as is more thoroughly discussed below, the primary reactor of U.S. Pat. No. 5,069,765 is modified so that ash and metal can be melted in the lower portion thereof to accomplish the removal of metal and vitrification of the ash in an easy and safe manner. Typically a source of steam is provided for the primary reactor so that the water can react with the carbonaceous material under pyrolizing conditions to produce hydrogen and carbon monoxide gas.

The raw product gas produced in the primary reactor is sent to a secondary reactor through a conduit. The secondary reactor may be a conventional pyrolitic reactor for pyrolytic decomposition therein such as the secondary reactor described in U.S. Pat. No. 5,069,765. The secondary reactor contains a bed of coke or other suitable carbon source for pyrolysis therein. In operation the secondary reactor receives the raw product gas from the primary reactor and carbon dioxide. The carbon dioxide and components of the raw product gas from the primary reactor undergo reaction in the secondary reactor when the bed of coke is heated to suitable pyrolizing temperatures as described for example in U.S. Pat. No. 5,069,765. An optional third reactor (tertiary reactor) may also be utilized. When a tertiary reactor is utilized, the product gas from the secondary reactor is fed into the tertiary reactor by means of a suitable conduit. The tertiary reactor may be the same as the secondary reactor.

The gas which is produced in the secondary reactor or the tertiary reactor in instances where a tertiary reactor is utilized, is subjected to filtration and scrubbing before it is sent to a furnace or power plant for combustion. Combustion of the gas produces carbon dioxide. A portion of the carbon dioxide produced during combustion serves as the source of carbon dioxide which is introduced into the secondary reactor.

Instead of using air as the oxidizing gas during combustion in the furnace or power plant, the present invention utilizes substantially pure oxygen as the oxidizing gas. The combustion process produces carbon dioxide. As noted above, a portion of the carbon dioxide is recycled to the secondary reactor where it is converted to carbon monoxide during the pyrolytic decomposition therein. The remaining portion of the carbon dioxide produced during the combustion procedure is recovered.

As noted above, the present invention uses substantially pure oxygen as the oxidizing gas and thus the oxidizing gas does not contain nitrogen as an expansion medium. A portion of the recovered carbon dioxide is therefore advantageously recirculated to the combustion chamber in the furnace or power plant for use as an expansion medium during the combustion process. The remaining portion of the recovered carbon dioxide may be used for various industrial applications.

A conventional oxygen generating plant is used to produce the substantially pure oxygen which is used in the present invention. Such plants typically produce nitrogen as a by-product. The nitrogen by-product is advantageously recovered for use in various industrial applications.

The above-described process does not produce any stack gases. Furthermore, the carbon dioxide which is recirculated to the secondary reactor is advantageously converted to carbon monoxide for use as a component in the synthesis gas for combustion.

As noted above, the primary reactor uses steam during the pyrolytic decomposition procedure. Thus the primary reactor produces hydrogen gas as one of the components in the raw gas product. When the hydrogen is eventually burned during the combustion step in the furnace or power plant, water is produced as a by-product along with the $CO_2$. The water may be separated from the $CO_2$ by any suitable method such as by condensation. The water produced as a by-product may be recirculated back to the primary reactor in the form of steam so that no other source of water is required for conducting the pyrolytic decomposition in the primary reactor. Optionally, a portion of the by-product steam may be introduced into the secondary or optional tertiary reactor so that hydrogen gas is produced during the pyrolytic decomposition in the secondary or optional tertiary reactors. Appropriate heat exchangers may be used to heat the by-product water to produce steam before it enters the primary, secondary or tertiary reactors. Such a heat exchanger may recover the heat contained in the synthesis gas which exits the secondary reactor or the optional third reactor to heat the by-product water for producing steam.

The above noted filtration and scrubbing of the synthesis gas is advantageously accomplished by sending the synthesis gas through an appropriate conduit to a series of carbon filled filters and then to first and second water scrubbing systems. The first water scrubber removes most of the particulates from the gaseous products. These particulate products then sink to the bottom of the first scrubbing system and may be recycled by means of a screw conveying system to the primary reactor where they will be subjected to pyrolytic decomposition reaction conditions. Recycling of the materials from the first water scrubbing system allows any remaining pyrolytically decomposed material to be pyrolyzed in the primary reactor and thus eliminates the need to discharge this type of material into the environment. The build-up of inert products that will not react, would be vitrified in the primary reactor thus eliminating any build-up of this product in the system.

The gas from the first water scrubbing system is then routed to a second water scrubbing system wherein other undesirable products such as sulphur compounds, etc., may be removed and recovered as useful by-products. In addition, particulate products removed in the second scrubbing system may be combined and recycled along with the particulates removed from the first scrubbing system. The particulates removed from the first and second scrubbing systems contain water. The particulates and water from these scrubbers are conveniently sent to a sludge tank for settling. These settled particles are conveniently recycled via a screw conveying system or other recycling device to the primary reactor. In addition, the sludge tank may receive spent filter material from the aforementioned filters. This spent filter material also settles in the sludge tank and is thus also recycled back to the primary reactor. Water from the sludge tank is advantageously recycled for make-up water to be used for example in the scrubbers.

In another embodiment of the invention the system is used without the primary reactor. Thus, in this embodiment there are no pyrolytic decomposition products introduced into the secondary reactor. Instead, the secondary reactor receives only carbon dioxide which has been produced as a combustion product in the power plant or generator.

In this second embodiment of the invention the secondary reactor produces only carbon monoxide due to the fact that the only gas entering the secondary reactor is carbon dioxide. Thus, pollutants from the primary reactor do not have to be removed from the product gas stream in this second embodiment of the invention. Accordingly, the filters, scrubbers and related apparatus for recycling products to the primary reactor are ordinarily not needed in this second embodiment of the invention.

This second embodiment of the invention produces carbon monoxide which can be directly combusted with the oxidizing gas in the same manner as described above with respect to the first embodiment of the invention. Of course, the combustion process in the second embodiment of the invention does not produce water as a by-product since hydrogen is not contained in the gas undergoing combustion.

A third embodiment is the same as the second embodiment with the only exception being that steam is included within the secondary and/or tertiary reactor to thereby produce hydrogen along with carbon monoxide. This third embodiment therefore results in the production of water and carbon dioxide during combustion. The carbon dioxide produced during combustion is advantageously separated from the water in the same manner as in the first or preferred embodiment of the invention and can be recycled to the pyrolytic decomposition reactor or reactors for use therein as a source of steam.

The secondary reactor used in the various embodiments of this invention receives $CO_2$ gas which is reacted with the coke contained therein according to the following chemical reaction:

$$CO_2+C \rightarrow +2CO$$

For each molecule of carbon dioxide which is recycled to the secondary reactor, a total of two molecules of carbon monoxide are formed. Thus, the quantity of carbon monoxide after each reaction is multiplied by 2 each time it is passed back through the reactor, i.e.

first pass=2
second pass=4
third pass=8
fourth pass=16
fifth pass=32
etc.

When steam is introduced into the secondary and/or tertiary reactor, the water molecules are broken down to form hydrogen gas and an oxygen radical which reacts with the coke in the secondary reactor. Each oxygen radical produces a molecule of carbon monoxide which is in addition to the two molecules of carbon monoxide produced by the reaction of one molecule of carbon dioxide with one carbon atom from the coke. Thus when steam is used in the secondary reactor, the above-noted geometric progression is as follows:

first pass=3
second pass=9
third pass=27
fourth pass=81
fifth pass=243
etc.

Of course, the above-noted geometric progression is limited by the size and capacity of the apparatus and the amount of carbon therein. The above noted geometric progression will proceed as long as the carbon dioxide is recirculated and as long as there is carbonaceous material available for pyrolytic decomposition.

DETAILED DESCRIPTION OF THE INVENTION AND PREFERRED EMBODIMENTS

Figure 1:
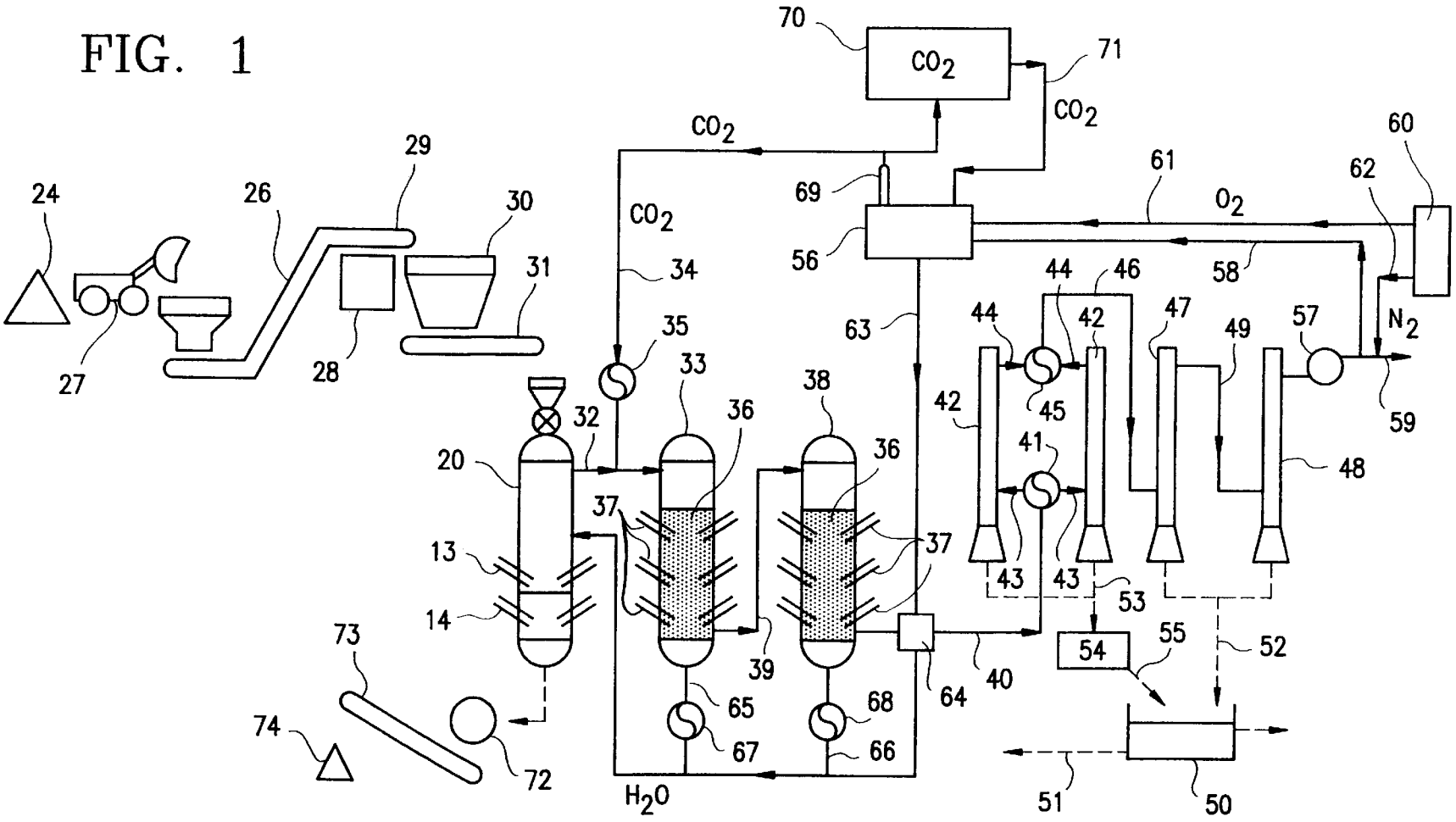
FIG. 1 is a schematic illustration of an embodiment of the invention.
Figure 2:
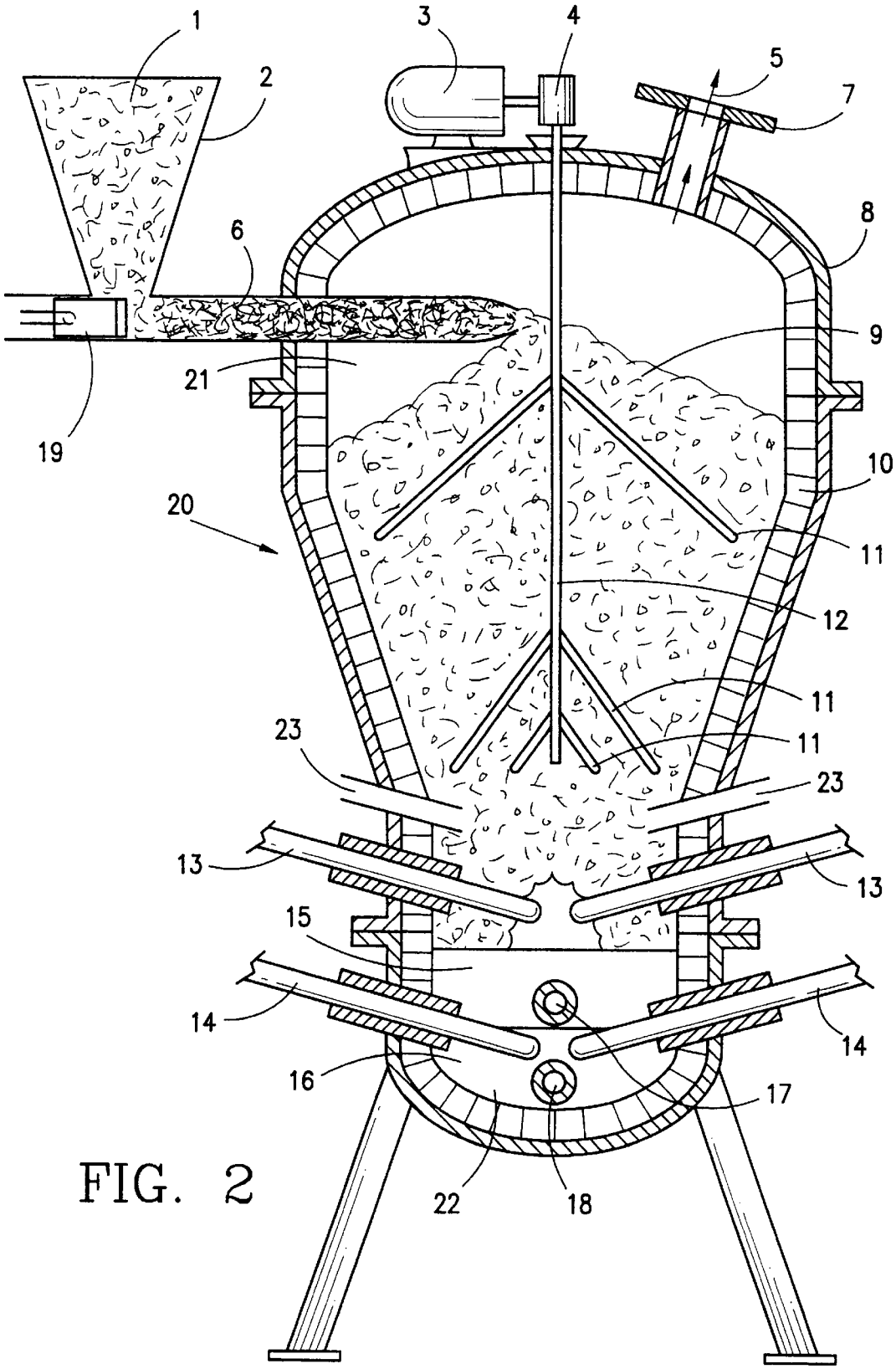
FIG. 2 is an illustration of a preferred embodiment of the primary reactor used in the invention.

In a preferred embodiment illustrated in FIG. 1, carbonaceous material which is to be pyrolytically decomposed is fed into a primary reactor 20. The preferred primary reactor is illustrated in FIG. 2. The reactor shown in FIG. 2 is a modified version of the primary reactor of U.S. Pat. No. 5,069,765. The modifications include replacing the water reservoir in the bottom portion of the reactor with a vitrification zone equipped with electrodes in the lower portion thereof. These electrodes provide heat for melting the ash for vitrification and melting the metal which enters the bottom portion of the reactor. A steam injection system replaces the water containing reservoir so that the reactor includes a source of water which is required for synthesis gas production in the primary reactor.

The preferred primary reactor indicated generally by reference numeral 20 in FIG. 2 includes chamber 21 which is formed by reactor shell 8. Pyrolytic decomposition occurs in chamber 21.

A vitrification zone 22 is included in the bottom portion of the reactor (i.e., the volume below the carbonaceous material in chamber 21 wherein molten ash and molten metal accumulate). Ash which falls into the vitrification zone is melted. Metal which melts during the pyrolysis procedure also enters the vitrification zone. The molten metal is heavier than the ash and therefore accumulates in a pool 16 found in the lower part of the vitrification chamber. The lighter melted ash floats on top of the molten metal as a molten slag layer 15. The heat required to melt the ash is provided by one or more protruding electrodes 14 which protrude through the reactor shell and lining into the lower portion of the vitrification chamber. Preferably there are three protruding electrodes 14 which are spaced about 120° around the circumference of the vessel so that during operation the electrodes automatically have a tendency to remain in the center of the melt. When electrical energy is applied to these electrodes in sufficient quantity, the ash products that have fallen to the bottom of the reactor will be melted, i.e., vitrified, into a molten, glass-like substance.

Lower tap hole 18 is provided in the bottom portion of the reactor for periodically draining molten metal 16. An upper tap hole 17 is provided for periodically draining the melted or vitrified ash 15. In operation, therefore, tap hole 17 would be opened to allow the vitrified slag products to drain out to the level of tap hole 17. Then tap hole 17 would be closed and tap hole 18 would be opened so that the molten metal such as molten iron can be drained from the reactor. The molten metal is conveniently drained into molds where it is cooled and the molded metal is then shipped to a refinery.

The vitrified or molten ash is also collected and solidified to form a glass-like substance which can be safely disposed of without any environmental concerns. In a preferred embodiment the collected molten ash is granulated in water granulator 72. The granulated ash may then be conveyed by conveyor 73 to produce vitrified waste pile 74.

It has been observed that in practice, a problem is encountered in the primary reactor described in U.S. Pat. No. 5,069,765. In particular, this problem referred to as "feed material bridging" is encountered within the reactor wherein the feed stock does not feed down continuously. To eliminate this problem, the primary reactor of the present invention preferably includes an agitator or other functionally equivalent structure which can knock loose the bridging material to thereby facilitate a continuous feed of material into the reaction zone. Preferably the agitator includes a rotatable shaft 12 with a plurality of agitator paddles 11 attached thereto. Agitator shaft 12 is conveniently rotated by any conventional motorized rotating device such as electric gear motor 3 and right angle gear drive 4.

Carbonaceous feed material 1 is fed into the primary reactor chamber 21 through compression feed tube 6 or other type of structure (screw conveyor or the like). Feed material 1 is placed into feed hopper 2 where it falls by gravity to compression feed tube 6. A feeder plunger 19 is advantageously provided for forcing feed material 1 through compression feed tube 6 and into chamber 21 where it accumulates to form a mass of carbonaceous material 9.

One or more protruding electrodes protrude through the reactor shell and lining to provide a source of heat at the lower portion of chamber 21. When electric energy is applied to these electrodes in sufficient quantity, the carbonaceous material is heated to produce pyrolytic decomposition conditions. Steam is injected into the lower portion of chamber 21 through steam injection pipe 23 so that steam is available for reaction with the heated carbonaceous material in the vicinity of the electrodes 13. In a preferred embodiment a plurality of steam injector pipes 23 are utilized. Most preferably the plurality of steam injector pipes are evenly distributed around the primary reactor 20.

The products of pyrolytic decomposition which includes gaseous hydrogen and carbon monoxide exit the primary reactor through gas outlet 5 which is formed by a flanged gas outlet tube 7.

The carbonaceous material (i.e., feed material 1) may be any pyrolytically decomposable material such as agricultural waste, wood chips and hogwood, petroleum coke, coal, solid municipal waste, sewage sludge, rubber tires, paper mill sludge, etc. In operation a feedstock pile of suitable waste material may be accumulated for use in this invention. Carbonaceous material from the feedstock pile 24 may be loaded onto a conventional belt conveyor by any suitable means such as a front end loader 27 or other type of equipment. A conventional magnetic separator is preferably included in the top of the belt conveyor to separate magnetic metal from the feed material. A tramp iron dumpster is advantageously located below the magnetic separator for the placement and accumulation of magnetic material therein. The belt conveyor feeds the carbonaceous feed material into a feed hopper/shredder 30. Feed material which exits the lower portion of feed hopper/shredder 30 is conveyed to the primary reactor by a weigh belt 31.

Synthesis gas produced in the primary reactor is sent to a secondary reactor 33 via conduit 32. Secondary reactor 33 also receives carbon dioxide gas which is obtained when the synthesis gas produced in accordance with this invention is eventually combusted. The carbon dioxide gas which is sent to the secondary reactor is advantageously supplied to the reactor through conduit 34 which joins conduit 32. A valve 35 may be included in conduit 34 to regulate the flow of carbon dioxide gas into conduit 32.

A bed of coke 36 (e.g., petroleum coke or metallurgical grade coke) is contained within secondary reactor 33. Pyrolytic decomposition conditions are established in the secondary reactor by energizing the electrodes 37. Optionally a third or tertiary reactor may be included. When a tertiary reactor is used, the gaseous products of pyrolytic decomposition obtained from the secondary reactor are sent to the tertiary reactor through conduit 39 which connects the secondary reactor and the third reactor in series. The tertiary reactor 38 operates in the same manner as the secondary reactor and therefore includes a bed of coke and electrodes for establishing pyrolytic decomposition conditions therein.

While the present invention utilizes a secondary reactor and an optional tertiary reactor, it will be understood that the secondary and tertiary reactors are essentially the same type of reactor. Thus, the invention merely requires the use of at least one secondary reactor and may optionally include one or more additional secondary rectors linked together in series. When the invention uses a second secondary reactor as illustrated in FIG. 1, the second secondary reactor is referred to herein as a tertiary reactor.

Preferably the coke utilized in the one or more secondary reactors is metallurgical grade coke. Instead of coke the one or more secondary reactors may utilize charcoal, coal, carbon obtained from rubber tires or other carbonaceous material having a high concentration of carbon.

Synthesis gas produced in the one or more secondary reactors is sent to one or more carbon filled filters via conduit 40. The gas in conduit 40 enters carbon filters 42 via conduits 43. The filtered gas exits the filters via conduits 44. Valves 41 and 45 are provided to control the flow of gases into and out of the filters. The filtered gas is then introduced to water scrubber 47 via conduit 46. Water scrubber 47 is connected in series with water scrubber 48 via conduit 49 so that gases from scrubber 47 pass through conduit 49 into scrubber 48. Water scrubber 47 removes most solid particulates from the gaseous products. These particulate products sink to the bottom of scrubber 47 along with water. The particulates and water from scrubber 47 are advantageously collected in sludge tank 50. In addition, other particulates and water from scrubber 48 may also be collected in sludge tank 50. Furthermore, water scrubber 48 also removes undesirable products such as sulphur compounds which may be collected from the scrubber and sold as by-products. Therefore the invention may include conventional means for recovering these undesirable products.

Spent carbon filter material from filters 42 is also advantageously collected in sludge tank 50. The solids in sludge tank 50 are allowed to settle and the water content of the sludge tank may be recycled for use as make-up water in the system. The solids material which collects on the bottom of the sludge tank (unders) is advantageously recycled to the feed hopper for introduction into the primary reactor wherein the solids undergo pyrolytic decomposition. The ash content of the recycled solids undergoes vitrification in the primary reactor as described above. Arrow 51 indicates the recycling of the solids from the sludge tank to the feed hopper 30. Arrow 52 illustrates the collection of particles and water obtained from scrubbers 47 and 48 into sludge tank 50. Arrow 53 illustrates the collection of spent filter material from filters 42 and arrow 55 illustrates the collection of the spent filter material into sludge tank 50.

The filtered and scrubbed synthesis gas passes from scrubber 48 to generator 56 via conduit 58. An induced draft fan 57 may be included at some point along the length of conduit 58 to assist the passage of the synthesis gas to generator 56. In an alternative embodiment, instead of combusting the synthesis gas in generator 56, the synthesis gas may be sent to a chemical plant via conduit 59.

Combustion of the synthesis gas takes place in generator 56. The oxidizing gas for supporting combustion is substantially pure oxygen which may be obtained in a conventional oxygen plant 60. Oxygen from oxygen plant 60 is sent to generator 56 via conduit 61.

Substantially pure oxygen is used as the oxidizing gas to avoid the production of nitrogen oxides during combustion in the generator. Carbon dioxide is introduced into the generator along with the substantially pure oxygen and the synthesis gas. The carbon dioxide which is introduced into the generator serves to dilute the oxygen and also serves as an expansion medium which is needed in order to obtain efficient use of the fuel. In other words the carbon dioxide used in the generator during combustion takes the place of nitrogen since nitrogen is removed from the air in the oxygen plant. The nitrogen which is removed from the air in the oxygen plant may be recovered as a separate product stream 62.

The term "substantially pure oxygen" means a level of purity which avoids production of unwanted or currently illegal levels of oxides of nitrogen in the stack gas. Preferably the substantially pure oxygen contains at least 97% oxygen and more preferably at least 99.5% oxygen, or higher. This level of purity is required to achieve the cleanest operation and lowest levels of nitrogen oxides produced in this system.

The above-described system which includes a primary reactor produces synthesis gas for combustion in the generator which is a mixture of carbon monoxide and hydrogen. Thus, combustion in the generator produces carbon dioxide and steam. The steam may be separated from the carbon dioxide by condensation to produce liquid water. The liquid water is conveniently recycled to the primary reactor for use therein via conduit 63 and heat exchanger 64. Heat exchanger 64 serves to produce steam from the heat contained in the synthesis gas passing through conduit 40. The steam in conduit 63 (downstream from heat exchanger 64) may also be sent to the secondary and/or tertiary reactors 33 and 38 (as well as any other secondary reactors utilized in the system) via conduits 65 and 66 respectively. Valves 67 and 68 may be included along the length of conduits 65 and 66 to control the flow of steam into the reactors.

Carbon dioxide produced during combustion exits the generator via conduit 69. A portion of the gas which passes through conduit 69 is recycled to the secondary reactor via conduit 34. The remaining portion of the carbon dioxide is collected in a conventional gas recovery device 70. The recovered carbon dioxide represents the portion of the carbon dioxide produced in generator 56 which has not been recycled to the secondary reactor. A portion of this recovered carbon dioxide is recycled to the generator via conduit 71. The carbon dioxide which is recycled to the generator via conduit 71 is mixed with the oxygen and synthesis gas so that it functions as an expansion medium during combustion. The remaining portion of the carbon dioxide represents an excess which can be removed from the system and used for various industrial applications.

What is claimed is:

1. A method for producing and burning synthesis gas which comprises:

pyrolytically decomposing carbonaceous material in a first pyrolysis reactor under pyrolyzing conditions in the presence of steam to produce a combustible gas which comprises hydrogen and carbon monoxide;

introducing said combustible gas into a second reactor containing a bed of carbonaceous material therein which produces carbon monoxide gas when subjected to pyrolysis conditions in the presence of carbon dioxide;

introducing carbon dioxide gas into said second reactor;

establishing pyrolysis conditions in said second reactor for pyrolytic decomposition therein so that carbon dioxide gas introduced into said second reactor reacts with said carbonaceous material therein to increase the amount of carbon monoxide contained in said combustible gas;

optionally introducing the combustible gas from the second reactor into one or more additional reactors, each additional reactor containing a bed of carbonaceous material therein which produces carbon monoxide gas when subjected to pyrolysis conditions in the presence of carbon dioxide, said carbonaceous material in said one or more additional reactors being maintained under pyrolysis conditions so that residual carbon dioxide contained in said combustible gas reacts which said carbonaceous material to further increase the amount of carbon monoxide contained in said combustible gas;

combining said combustible gas having an increased carbon monoxide content, with carbon dioxide gas and substantially pure oxygen to produce a combustible mixture;

burning said combustible mixture to produce heat and chemical products of combustion which comprise carbon dioxide and water;

recovering said carbon dioxide and using a portion of said recovered carbon dioxide as a source of said carbon dioxide gas contained in said combustible mixture and as a source of said carbon dioxide gas which is introduced into said second reactor.

2. The method of claim 1 which further includes the step of filtering and scrubbing the combustible gas in which the carbon monoxide content has been increased to cleanse said combustible gas and to recover particulates therefrom.

3. The method of claim 2 wherein said scrubbing results in the accumulation of solid carbonaceous material which is recovered and recycled to said first pyrolysis reactor for pyrolytic decomposition therein.

4. The method of claim 3 wherein said scrubbing uses water and said water is recovered and reused for said scrubbing.

5. The method of claim 4 wherein said combustible gas is filtered in a filter which uses carbon as the filtering material whereby said carbon becomes spent during filtration and said spent carbon is removed and sent to said first pyrolysis reactor for pyrolytic decomposition therein.

6. The method of claim 1 wherein said water produced during the burning of said combustible mixture, is used as a source of steam in said first pyrolysis reactor.

7. The method of claim 6 wherein pyrolytic decomposition in said second and/or said one or more additional reactors is conducted in the presence of steam and a portion of said water produced during the burning of said combustible mixture is used as a source of said steam in said second and/or said one or more additional reactors.

8. The method of claim 1 wherein said heat is used to produce mechanical energy or electricity.

9. The method of claim 1 wherein any metal contained in said carbonaceous feed becomes molten in said first pyrolysis reactor and said first pyrolysis reactor includes a bottom portion for the accumulation of ash and molten metal therein; said bottom portion containing one or more heating elements to melt said ash whereby said ash becomes molten and forms a molten slag layer which floats on top of said molten metal contained in the bottom portion of said first pyrolysis reactor; said first pyrolysis reactor further including an upper tap hole for eliminating said molten ash therefrom, and a lower tap hole for eliminating molten metal therefrom; and said process includes the step of periodically removing molten ash and said molten metal from said first pyrolysis reactor and solidifying said molten ash and said molten metal after removal from said first pyrolysis reactor.

10. The method of claim 1 wherein said carbonaceous material is selected from the group consisting of charcoal, coke, coal and carbon obtained from rubber tires.

11. The method of claim 1 wherein said carbonaceous material in said second reactor and said one or more additional reactors is metallurgical grade coke.

12. The method of claim 7 wherein each molecule of $CO_2$ which is introduced into said second reactor reacts with the carbonaceous material therein to produce two molecules of CO and each molecule of $H_2O$ introduced into said second reactor reacts with the carbonaceous material therein to produce an additional molecule of CO; said reactions of said $CO_2$ and said $H_2O$ with said carbonaceous material will take place as long as $CO_2$ is introduced into said second reactor and as long as there is carbonaceous material available for pyrolysis in said second reactor.

13. The method of claim 1 wherein heat required for conducting the reactions in said first and second reactors is supplied by energizing one or more electrodes which protrude into said first and second reactors.

14. A method for producing and burning synthesis gas which comprises:

introducing carbon dioxide gas into a pyrolysis reactor, said reactor containing a bed of carbonaceous material therein which produces carbon monoxide gas when subjected to pyrolysis conditions in the presence of carbon dioxide;

establishing pyrolysis conditions in said pyrolysis reactor so that said carbon dioxide gas reacts with said carbonaceous material therein to produce a combustible gas which comprises carbon monoxide;

optionally introducing the combustible gas produced in said pyrolysis reactor into one or more additional pyrolysis reactors, each additional reactor containing a bed of carbonaceous material therein which produces carbon monoxide gas when subjected to pyrolysis conditions in the presence of carbon dioxide, said carbonaceous material in said one or more additional pyrolysis reactors being maintained under pyrolysis conditions so that residual carbon dioxide contained in said combustible gas reacts with said carbonaceous material in said one or more additional reactors to further increase the amount of carbon monoxide contained in said combustible gas;

combining said combustible gas having an increased carbon monoxide content with carbon dioxide gas and substantially pure oxygen to produce a combustible mixture;

burning said combustible mixture to produce heat and chemical products of combustion which comprises carbon dioxide;

recovering said carbon dioxide and using a portion of said recovered carbon dioxide as a source of said carbon dioxide gas contained in said combustible mixture and as a source of said carbon dioxide gas which is introduced into said pyrolysis reactor.

15. The method of claim 14 wherein said carbonaceous material is selected from the group consisting of charcoal, coke, coal, and carbon obtained from rubber tires.

16. The method of claim 15 wherein said carbonaceous material in said pyrolysis reactor and said one or more additional pyrolysis reactors is metallurgical grade coke.

17. The method of claim 16 wherein said combustible mixture consists of carbon monoxide, substantially pure oxygen and carbon dioxide.

18. The method of claim 1 wherein said combustible mixture consists of carbon monoxide, substantially pure oxygen and carbon dioxide.

19. The method of claim 16 wherein the chemical products of combustion consists of carbon dioxide.

20. The method of claim 1 wherein the chemical products of combustion consist of carbon dioxide and water.

21. The method of claim 1 which has zero emissions of gas into the environment.

22. The method of claim 9 which is a closed loop system wherein no gases are released into the environment except for the recovered carbon dioxide and wherein no liquid is released into the environment and no solids are released into the environment except for the solidified molten metal and the vitrified ash.

23. The method of claim 1 wherein said substantially pure oxygen is obtained from an oxygen plant which produces nitrogen as a byproduct.

24. The method of claim 16 which further includes the steps of:

introducing water into said pyrolysis reactor and/or into said optional additional pyrolysis reactors so that hydrogen gas is produced during pyrolysis whereby said combustible gas includes hydrogen as a component thereof and said products of combustion include water;

introducing said water into said pyrolysis reactor or said optional one or more additional pyrolysis reactors as a source of steam therein.

25. The method of claim 16 wherein the only gas introduced into said pyrolysis reactor is $CO_2$ and the only carbonaceous material in said pyrolysis reactor is said metallurgical grade coke and said combustible mixture is burned without any filtering or scrubbing thereof.

26. The method of claim 14 wherein heat for reacting said carbon dioxide gas with said carbonaceous material to produce carbon monoxide is supplied by energizing one or more electrodes which protrude into said pyrolysis reactor.

* * * * *